US005998343A

United States Patent [19]

Ishii

[11] Patent Number: 5,998,343

[45] **Date of Patent: *Dec. 7, 1999**

[54] COMPOSITION FOR CLEANING AND COATING INSIDE OF INTERNAL COMBUSTION ENGINE AND METHOD FOR CLEANING AND COATING INSIDE OF INTERNAL COMBUSTION ENGINE USING SAID COMPOSITION

[75] Inventor: Noboru Ishii, Tokyo, Japan

[73] Assignee: Better Mask Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/909,081

[22] Filed: Aug. 14, 1997

Related U.S. Application Data

[63] Continuation of application No. PCT/JP95/00281, Feb. 24, 1995.

[30] Foreign Application Priority Data

Feb. 13, 1993 [JP] Japan ..... 5-312134

[51] Int. Cl.[6] ..... C11D 1/94; C11D 3/18; C11D 3/44

[52] U.S. Cl. ..... 510/185; 510/421; 510/508; 510/510

[58] Field of Search ..... 510/185, 508, 510/421, 510; 252/380, 389.52

[56] References Cited

U.S. PATENT DOCUMENTS 4,759,860 7/1988 Tanaka et al. ..... 252/32.5
5,320,765 6/1994 Fetterman, Jr. et al. .

FOREIGN PATENT DOCUMENTS 7-166193 6/1995 Japan ..... C11D 3/60

*Primary Examiner*—Yogendra Gupta
*Assistant Examiner*—Gregory E. Webb
*Attorney, Agent, or Firm*—Pillsbury MAdison & Sutro LLP

[57] ABSTRACT

Provided is a composition for cleaning and coating of the inside of internal combustion engines and cleaning and coating metallic surface of rotating parts and sliding parts of the engines which contains a zinc phosphate, a solvent, a surface active agent, a natural vegetable oil and a mineral oil as components. This composition diminishes friction applied to rotating parts and sliding parts of internal combustion engines and diminishes friction loss by cleaning and coating and, in addition, reduces causes for incomplete combustion in combustion chamber to improve performance of engines and inherent performance of internal combustion engines. Further provided is a method for cleaning and coating of engines using said composition.

6 Claims, No Drawings

COMPOSITION FOR CLEANING AND COATING INSIDE OF INTERNAL COMBUSTION ENGINE AND METHOD FOR CLEANING AND COATING INSIDE OF INTERNAL COMBUSTION ENGINE USING SAID COMPOSITION

This is a Continuation International Appln. No. PCT/JP95/00281 filed Feb. 24, 1995 which designated the U.S.

TECHNICAL FIELD

The present invention relates to a composition for cleaning and coating the inside of internal combustion engines and a method for cleaning the inside of internal combustion engines and for coating rotating parts and sliding parts of internal combustion engines, especially metallic parts thereof using said composition.

BACKGROUND ART

At present, dirt caused by oxidation waste matters such as sludges and carbon accumulated in internal combustion engines is removed by a method which requires technical skill and patience to disassemble parts of internal combustion engines, remove the dirt adhering or stick to the parts by cleaning and assemble the parts again. However, complete cleaning is very difficult because there are parts which cannot be easily disassembled or delicate parts having fine pores. Of course, the well known cleaning method with flushing oil is carried out, but according to this method only the surface of the dirt is washed and substantially no cleaning effect can be obtained.

As mentioned above, cleaning of the inside of internal combustion engines must resort to a method which requires patience, time and cost for disassembling and fixing by an expert. Furthermore, wear marks and fine scars on the surface of metallic sliding parts caused by friction at rotating parts and sliding parts of internal combustion engines and strain friction generated by fine rugged pores of metal per se are causes for friction loss such as generation of slight vibration and uneven rotation. Thus, they decrease combustion energy (power energy) to cause deterioration in performance of internal combustion engines.

The internal combustion engines to be treated include gasoline engines, diesel engines, propane engines, rotary engines used in general cars, buses, trucks and motor bicycles which must be subjected to regular automobile inspection and registration and, furthermore, engines for agricultural equipments, engines for construction vehicles, engines for ships, industrial engines (for compressors, generators and air-conditioners) and engines for aircrafts. Especially, strain friction in engines (internal combustion engines) for cars including imported cars and motor bicycles causes incomplete combustion due to delicate deviation (a lag in timing of ignition and valve operation) in interlocking operation process of mechanism leading to intake, compression, combustion and exhaustion (valve system, rotating parts, sliding parts) which must be kept regular. As a result, deterioration in performance is brought about, and not only deterioration of inherent performances such as starting and accelerating performances, but also increase of engine noise caused by metallic fatigue, decrease of lubricity caused by ununiform oil film in the rotating part and sliding part increase frictional resistance (friction loss) and simultaneously cause deterioration of airtightness and compressive power in combustion chamber. Furthermore, they cause social problems such as decrease in fuel consumption performance resulting from incomplete combustion such as decrease in combustion power (decrease in explosion power) and contamination of living environment due to increase of carbon monoxide and hydrocarbon contents in exhaust gas.

DISCLOSURE OF INVENTION

The inventors have conducted intensive research in an attempt to find a method for improving performance of internal combustion engines by completely cleaning and discharging carbon, sludges and the like deposited and accumulated inside internal combustion engines, especially adhering oxidation waste matters and simultaneously by coating and mending the surface of metallic parts such as rotating parts and sliding parts having roughness and flaws such as friction marks, wear marks and hairlines without employing a method which requires labor and time for disassembling, cleaning of the parts and assembling. As a result, the present invention has been accomplished.

The present invention provides a method for cleaning and discharging (removing) the adhering oxidation waste matters in internal combustion engines without disassembling the engine into parts and simultaneously coating (mending of coat) the roughened surface by friction reaction.

Furthermore, the present invention provides a cleaning and coating composition used for the method of cleaning and coating without disassembling the internal combustion engines into the parts.

The composition for cleaning and coating of inside of internal combustion engines according to the present invention is mainly composed of a zinc phosphate, a solvent, a surface active agent, a mineral oil and a natural vegetable oil.

BEST MODE FOR CARRYING OUT THE INVENTION

That is, the first aspect of the present invention relates to a composition for cleaning and coating of the inside of internal combustion engines which is mainly composed of a zinc phosphate, a solvent, a surface active agent, a mineral oil and a natural vegetable oil.

The second aspect relates to a composition for cleaning and coating of the inside of internal combustion engines which contains 0.35–3.5% by weight of a zinc phosphate, 25–45% by weight of a solvent, 3.5–18% by weight of a surface active agent, 6–12% by weight of a mineral oil 9.5–63.55% by weight of water and 1.6–12% by weight of a natural vegetable oil, the total amount of the zinc phosphate, the solvent, the surface active agent, the mineral oil, the natural vegetable oil and water being 100% by weight.

The third and fourth aspects relate to a method for cleaning and coating of the inside of internal combustion engines using the composition for cleaning and coating of the inside of internal combustion engines of the above aspects 1 or 2.

The present invention will be explained in more detail below.

In this specification, the zinc phosphate means not only zinc phosphate tetrahydrate, but also zinc dialkyldithiophosphates, zinc diaryldithio-phosphates, mixtures of dialkyldithiophosphate esters and zinc oxide and mixtures of alkyl alcohols or aryl alcohols, phosphorus pentasulfide ($P_2S_5$) and zinc oxide.

Furthermore, compositions containing a zinc phosphate which are commercially available in the name of "Zinc" as an engine oil supplying agent are also included.

The zinc phosphates can secure lubrication in engines, and can allow uniform coating (impregnation) and repair of the roughened metallic surface of rotating parts and sliding parts having hairlines, flaws and fine unevenness (pore portions) which cause friction loss, thereby to balance and normalize (correct and cure) the distorted rotation and sliding (lubrication) to result in decrease of frictional resistance in the parts and improve rotation of engine (performance) and combustion performance.

Amount of the zinc phosphates in the composition is 0.35–3.5% by weight. If the amount is less than 0.35% by weight, the coating effect is insufficient and if it is more than 3.5% by weight, no greater improvement in coating effect can be obtained.

The zinc dithiophosphates are dispersed in a mineral oil, followed by mixing and dispersing with other components. That is, when zinc phosphate tetrahydrate is used, it is dissolved in a small amount of water (usually water containing a small amount of an acid or alkali being used) and then mixed and dispersed with a mineral oil so that it is contained in an amount of 0.35–3.5% by weight in the composition.

Commercially available mineral oils can be used, but bright stock (or bottom) oils (virgin oils of high concentration) are suitably used. Amount of the mineral oil in the total composition can be optionally selected from the range of 6–12% by weight based on the total weight of the composition.

The commercially available product called "Zinc" already contains about 5% by weight to about 23% by weight of a zinc phosphate in mineral oil. Therefore, when this is used as it is, this can be added in an amount of about 6.3 to about 15.4 parts by weight for 100 parts by weight of the composition. In this case, of course, the mineral oil is not needed because it is contained in "Zinc".

The solvents used in the present invention are petroleum solvents such as, for example, aromatic solvents, aliphatic solvents or mixtures thereof.

There may be used various petroleum solvents such as, for example, Pegasole AN-45 and Pegasole 3040 manufactured by Mobil Chemical Co., Ltd.; EXXSOL D40, D80, D110, Isopar M and Isopar H manufactured by Exxon Co., Ltd.; A Solvent, K Solvent, Tecleen Series N-20, N-22 and N-24 manufactured by Nippon Oil Co., Ltd.; IP Solvent-1620 and 2028 manufactured by Idemitsu Petrochemical Co., Ltd.; NS Clean 100 and 110 manufactured by Nikko Sekiyu Co., Ltd.; Mineral Terpene and Solvent manufactured by Mitsubishi Oil Co., Ltd.; and Shellzole 70 and Shellzole 71 manufactured by Shell Japan Co., Ltd.

The solvents are used for mixing with and dissolution of other components used in the composition and for dissolution and removal of oxidation waster matters such as carbon and sludges deposited and accumulated inside the engines or adhering to the inside of engines. The solvents are preferably those which are suitable for dissolution and excellent in penetration action into complicated, intricate and narrow portions of rotating parts and sliding parts which are beyond reach even if disassembled, such as cam shaft, rocker arm, rocker shaft, crankshaft, pin and bearing, tappet, push rod, valve, spring, cylinder liner, piston and pin, compression ring, oil ring, bearing, connecting rod, connecting rod cap, oil strainer, oil passage (oil gallery), and plain metal bearing. Of course, these solvents must be selected taking into consideration the conditions that they exert no evil influence (bad effect) upon other engine parts (packing such as gasket and sealing parts) and that they are low in dangerousness such as explosiveness and flammability. Amount of the solvents is 25–45% by weight based on the total amount of the composition. If the amount is less than 25% by weight, the effect to remove oxidation waste matters is not sufficient and if it is more than 45% by weight, there may occur problems in combustibility and hence use of them in an amount of up to 45% by weight is preferred.

As the surface active agents, there may be used anionic, nonionic, amphoteric and cationic surface active agents. These may be used each alone or as a mixture.

The first object to use the surface active agents is to emulsify and disperse each component of the composition. The second object is to exhibit the action as an aid for acceleration of liberation and dissolution of oxidation waste matters such as carbon and sludges by penetration and activation power (activation action) and the third object is to disperse (emulsify) combustible compositions such as petroleum solvent and natural vegetable oil in water, thereby to neutralize into moderate effect with no evils and besides to neutralize and solve the dangers such as flammability.

Any of anionic, nonionic, amphoteric and cationic surface active agents may be used, but suitable are nonionic alkylphenylpolyoxyethylene ether surface active agents and polyethylene glycol fatty acid ester surface active agents.

Amount of the surface active agents is 3.5–18% by weight based on the total amount of the composition and this is sufficient. If the amount is less than 3.5% by weight, the effect to emulsify and disperse all the components is insufficient and if it is more than 18% by weight, the problem of bubbling occurs and no further improvement of detergency can be expected.

The natural vegetable oils are used for effective coalescent mixing of the components and acceleration of dissolution and removal of especially the sticking oxidation waste matters such as carbon and sludges adhering to and accumulated in the inside of engines and for exhibiting masking effect for offensive smell of the composition.

The natural vegetable oils include terpineol, d-limonene, eugenol and l-carvone. Amount of the natural vegetable oils is 1.6–12% by weight based on the total composition.

If the amount is less than 1.6% by weight, the masking effect is insufficient and 12% by weight is enough to exhibit the masking effect and the masking effect no longer increases even when more than this amount is employed. Thus, 12% by weight suffices.

The composition of the present invention is made up to 100 parts by weight in total by adding water to a blend of the above components. Usually, amounts of other components are selected so that amount of water is 28–55% by weight based on the total composition. Of course, water can be added to the blend of the above components at the time of use.

Therefore, a blend containing the above components at the above proportion, namely, 0.35–3.5 parts by weight of a zinc phosphate, 6–12 parts by weight of a mineral oil, 25–45 parts by weight of a solvent, 3.5–18 parts by weight of a surface active agent and 1.6–12 parts by weight of a natural vegetable oil, is also one of the embodiments of the present invention.

Water is preferably pure water or distilled water, but any clear water can be used.

Since the cleaning composition of the present invention is used in internal combustion engines after lubricating oil has been drawn out of the engines, it is required to have a property of capable of securing the lubricity as much as possible. Therefore, each component may be selected so that lubricity can be obtained as a property.

The cleaning and coating composition can be prepared by mixing the components and stirring the mixture, and the mixing method and the stirring method are not limiting.

Next, the cleaning and coating method according to the present invention will be explained below.

The cleaning and coating method of the present invention can be applied to any internal combustion engines regardless of the kind. That is, it can be applied to various internal combustion engines for cars, buses, trucks, motor bicycles, construction vehicles, agricultural equipments, ships, aircrafts, air-conditioners, generators and compressors, such as, for example, gasoline engines, diesel engines, LPG engines, rotary engines and others.

The method of cleaning and coating of internal combustion engines according to the present invention comprises pouring the above composition into the engine in place of engine oil after completely drawing engine oil out of internal combustion engine and circulating the composition in the whole engine through oil passages (oil gallery) for a certain period of time, to allow the composition to contact and friction react with especially its rotating parts and sliding parts (the respective engine parts).

The cleaning and coating method of the present invention will be explained taking the case of automobile engine.

The composition is used for cleaning and coating in an amount of 80–120% based on the amount of engine oil used.

First, drain cock of the oil pan is opened and all engine oil is drawn out.

The drain cock of the oil pan is completely closed and thereafter the composition of the present invention in an amount of 80–120% based on the amount of the used engine oil is poured from an engine oil pouring port.

Then, the engine is started and idled for a given time, for example, about 1–5 minutes to circulate the composition through the whole engine.

The engine is stopped and left to stand for 10–30 minutes after stopping, and again idled. The idling is effected for at least 10–30 minutes and the engine is again stopped. The drain cock is opened and all of the cleaning composition used for cleaning is drawn out.

After all of the composition has been drawn out, further idling for 5–20 minutes using a flushing oil is carried out for removal of the composition as used which remains in the engine, whereby the engine is rinsed. This rinsing is carried out desirably at least two times.

After completion of the cleaning, the oil filter is exchanged for a fresh filter and a specified amount of a fresh engine oil is poured into the engine.

By carrying out the above operations, not only the engine is completely cleaned, but also the metallic surface of rotating parts and sliding parts of the engine is coated. As a result, the surface of the rotating parts and sliding parts of the engine becomes smooth, the frictional resistance decreases, and the power performance (output) and fuel consumption are improved without reducing explosive energy (expansion energy). Of course, life of engine is also prolonged.

The following examples will further illustrate the invention, which are never limiting the invention.

EXAMPLE 1 (Composition)

A "Zinc" product (zinc thiophosphatezinc dithiophosphate) which comprised an oil previously containing the zinc phosphate in an amount of 1.25% by weight in the total composition and a mineral oil in an amount of 5.75% by weight, the total amount of the zinc phosphate and the mineral oil in the total composition being 7% by weight, was added to a mixture comprising 26 parts by weight of naphthenic paraffin petroleum solvent: Nippon Oil N-22, 6 parts by weight of d-limonene as a natural vegetable oil, and 8 parts by weight of a nonionic surface active agent: nonylphenol EO adduct and 5 parts by weight of an imidazolium betaine amphoteric surface active agent as surface active agents, and these were thoroughly stirred. After stirring, water was added to make up 100 parts by weight in total, followed by further stirring to obtain a cleaning and coating composition.

EXAMPLE 2 (Composition)

A cleaning and coating composition was obtained in the same manner as in Example 1, except that 5 parts by weight of a nonionic surface active agent polyethylene glycol fatty acid ester was used in place of 5 parts by weight of the imidazolium betaine amphoteric surface active agent.

EXAMPLE 3 (Composition)

A cleaning and coating composition was obtained in the same manner as in Example 1, except that 5 parts by weight of a cationic surface active agent: monoalkylammonium chloride was used in place of 5 parts by weight of the imidazolium betaine amphoteric surface active agent.

EXAMPLE 4 (Cleaning and coating method)

Cleaning and coating were carried out using the cleaning and coating composition obtained in Example 1 under the following conditions.

Cleaning and Coating Conditions:

1. Car to be cleaned:

Daihatsu·Charade GT-XX Twin Cam·Turbo Car of Type 1988 (model: G-100S).

Cylinder volume: 1000 cc

Distance covered: 108,000 km.

2. Engine performance of the car to be cleaned:

(1) Measurement of concentration of carbon monoxide (CO) and hydrocarbon (HC) in exhaust gas from the engine before cleaned:

CO concentration: 0.2%

HC concentration: 260 PPM

The maximum output measured by chassis dynamo was 74.6 horsepower (catalog data: 105 horsepower).

(2) Steps of cleaning and coating were as follows.

(i) Oil was completely drawn out and the cleaning and coating composition of the present invention was poured.

(ii) Idling was carried out for 1 minute without stepping on the accelerator.

(iii) Engine was stopped and left to stand for 15 minutes.

(iv) Idling was again carried out for 10 minutes without stepping on the accelerator.

(v) The drain cock was opened and the cleaning and coating composition of the present invention was drawn out and cleaning was carried out twice with a flushing mineral oil.

(vi) Oil element was exchanged for new one and oil was exchanged.

3. Engine performance after cleaning and coating:

CO concentration: 0.0% (no detection even after measurement for longer than the specified period)

HC concentration: 200 PPM

The maximum output was improved to 95.2 horsepower which was near the catalog data.

The cleaning and coating agent drawn out changed to deep brown in its color, which showed that it removed carbon and sludges inside the engine, and furthermore, the cleaning and coating agent which was in "smooth state" and free-flowing before use changed to "thick state".

From the above results, the cleaning and coating composition of the present invention is considered to have markedly excellent cleaning action, and moreover, regarding the improvement of the output, it must be concluded that function of the engine per se was recovered considering the covered distance of the car used.

In addition, mechanical noise conspicuously diminished, resulting in stillness. This is considered to be an effect of coating of rotating and sliding parts (as a result of mending).

EXAMPLE 5 (Cleaning and coating method)

The same procedure as in Example 4 was repeated using a Nissan Pulsar 1700 cc diesel of November, 1992 type (model: X-SN14, motor CD-17) of 9982 km in the distance covered.

Concentration of black smoke in waste gas of this car before subjected to cleaning and coating treatment of the present invention was 58% measured by a smoke checker.

When the concentration was again measured after completion of cleaning and coating, it was markedly improved to 44%. Furthermore, mechanical noise vanished from engine sound at the time of idling and the sound became "mellow". Moreover, black smoke at idling disappeared and the number of engine rotation which was at most 3,000–4,000 could be increased to red zone at a stretch.

According to the results of test travelling, the maximum speed before the test was 140 km/hour by the meter reading while it increased to higher than 170 km/hour by the maximum speed meter reading after the engine was subjected to the treatment according to the method of the present invention. It was confirmed that blowing up in the whole rotation zone became smooth, accelerator response conspicuously increased, so-called "reaching uppermost limit" was overcome, and black smoke in the exhaust gas decreased to such extent as unrecognized.

Furthermore, according to the continuous test travelling, the results when about 9 months elapsed after cleaning and coating treatment are as follows.

(1) State of the car at present:

Travelling distance: about 30000 km

Engine troubles, etc.: None (2) No trouble was seen after travelling of about 20000 km.

(3) Concentration of black smoke in exhaust gas measured by a smoke checker was 47% and the concentration somewhat increased. However, the black smoke was seen at the starting of engine, but no black smoke was seen during driving and in high rotating zone.

I claim:

1. A composition for cleaning and coating of inside of internal combustion engines which comprises a zinc phosphate, a surface active agent, a natural vegetable oil, a mineral oil and a solvent other than said natural vegetable oil and said mineral oil.

2. A composition for cleaning and coating of inside of internal combustion engines which comprises 0.35–3.5% by weight of a zinc phosphate, 25–45% by weight of a solvent, 3.5–18% by weight of a surface active agent, 6–12% by weight of a mineral oil and 1.6–12% by weight of a natural vegetable oil, the total amount of the zinc phosphate, the solvent, the surface active agent, the mineral oil, the natural vegetable oil and water being 100% by weight.

3. A method for cleaning and coating inside of internal combustion engines using the composition for cleaning and coating of inside of internal combustion engines as defined in claim 1 or 2.

4. The composition of claim 1, wherein said surface active agent is water soluble.

5. The composition of claim 1, wherein said surface active agent is hydrophilic.

6. The composition of claim 1, wherein said surface active agent forms an emulsion when mixed with water.

* * * * *